US010494788B2

(12) United States Patent
Glasser et al.

(10) Patent No.: US 10,494,788 B2
(45) Date of Patent: Dec. 3, 2019

(54) SYSTEM AND METHOD FOR DEFINING A ZONE OF OPERATION FOR A LIFT ARM

(71) Applicant: Clark Equipment Company, West Fargo, ND (US)

(72) Inventors: David Glasser, Bismarck, ND (US); Jonathan Roehrl, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 0 days.

(21) Appl. No.: 15/802,030

(22) Filed: Nov. 2, 2017

(65) Prior Publication Data

US 2018/0119383 A1 May 3, 2018

Related U.S. Application Data

(60) Provisional application No. 62/416,349, filed on Nov. 2, 2016.

(51) Int. Cl.

| | |
|---|---|
| ***E02F 3/43*** | (2006.01) |
| ***E02F 9/20*** | (2006.01) |
| ***E02F 9/12*** | (2006.01) |
| *E02F 9/22* | (2006.01) |

(52) U.S. Cl.

CPC ..... *E02F 3/435* (2013.01); *E02F 9/121* (2013.01); *E02F 9/2004* (2013.01); *E02F 9/22* (2013.01)

(58) Field of Classification Search

CPC . E02F 3/435; E02F 9/121; E02F 9/123; E02F 9/2033; E02F 9/2037; E02F 9/2004; E02F 9/22

USPC ..... 701/50

See application file for complete search history.

(56) References Cited

U.S. PATENT DOCUMENTS

| | | | |
|---|---|---|---|
| 4,746,264 | A | 5/1988 | Kishi et al. |
| 4,910,673 | A | 3/1990 | Narisawa et al. |
| 5,062,266 | A | 11/1991 | Yoshimatsu |
| 5,063,742 | A | 11/1991 | Yoshimatsu |
| 5,159,813 | A | 11/1992 | Yoshimatsu et al. |
| 5,272,877 | A | 12/1993 | Fukushima et al. |
| 5,383,390 | A | 1/1995 | Lukich |
| 5,461,803 | A | 10/1995 | Rocke |
| 5,636,516 | A | 6/1997 | Kon |
| 5,657,544 | A | 8/1997 | Ota et al. |
| 5,823,369 | A | 10/1998 | Kuromoto |
| 6,113,276 | A | 9/2000 | Bourgeois-Jacquet |

(Continued)

FOREIGN PATENT DOCUMENTS

| | | |
|---|---|---|
| EP | 0416180 A1 | 3/1991 |
| FR | 2517659 A1 | 6/1983 |

(Continued)

OTHER PUBLICATIONS

International Search Report and Written Opinion from the European Patent Office dated Apr. 13, 2018 for International Application No. PCT/US2017-059736 filed Nov. 2, 2017, 16 pages.

*Primary Examiner* — Marthe Y Marc-Coleman

(74) *Attorney, Agent, or Firm* — John D. Veldhuis-Kroeze; Westman, Champlin & Koehler, P.A.

(57) ABSTRACT

Power machines such as excavators having a house that rotates about a vertical axis on an undercarriage are disclosed. In certain conditions, a control system on the excavator can limit rotational movement of the house and/or pivoting of a swing function on a lift arm to contain work performed by an implement to a predefined range or work area.

19 Claims, 13 Drawing Sheets

(56) References Cited

U.S. PATENT DOCUMENTS

| | | | |
|---|---|---|---|
| 6,199,442 | B1 | 3/2001 | Bauer et al. |
| 6,339,929 | B1 | 1/2002 | Udagawa et al. |
| 6,363,632 | B1 | 4/2002 | Stentz et al. |
| 6,442,439 | B1 | 8/2002 | Robinett, III et al. |
| 6,481,296 | B2 | 11/2002 | Jin et al. |
| 6,618,967 | B2 | 9/2003 | Satzler et al. |
| 6,672,175 | B2 | 1/2004 | Jin et al. |
| 6,867,584 | B1 | 3/2005 | Kurita et al. |
| 6,906,513 | B2 | 6/2005 | Dunisch et al. |
| 6,968,264 | B2 | 11/2005 | Cripps |
| 7,067,999 | B2 | 6/2006 | Sugano et al. |
| 7,157,907 | B2 | 1/2007 | Sato |
| 7,610,136 | B2 | 10/2009 | Okamura et al. |
| 7,710,110 | B2 | 5/2010 | Patil et al. |
| 7,726,048 | B2 | 6/2010 | Stanek et al. |
| 7,772,792 | B2 | 8/2010 | Kawaguchi et al. |
| 7,831,333 | B2 | 11/2010 | Sawodny et al. |
| 7,970,521 | B2 | 6/2011 | Sorensen et al. |
| 8,016,363 | B2 | 9/2011 | Jackson et al. |
| 8,065,060 | B2 | 11/2011 | Danko |
| 8,180,532 | B2 | 5/2012 | O'Halloran et al. |
| 8,405,328 | B2 | 3/2013 | Komiyama et al. |
| 8,437,923 | B2 | 5/2013 | Sano et al. |
| 8,511,490 | B2 | 8/2013 | Kawai et al. |
| 8,527,158 | B2 | 9/2013 | Faivre et al. |
| 8,577,564 | B2 | 11/2013 | Stanek |
| 8,694,204 | B2 | 4/2014 | Reeb et al. |
| 8,752,373 | B2 | 6/2014 | Yamashita et al. |
| 8,798,872 | B2 | 8/2014 | Kagoshima et al. |
| 8,816,678 | B2 | 8/2014 | Kitanaka et al. |
| 8,818,649 | B2 | 8/2014 | Udagawa |
| 8,826,656 | B2 | 9/2014 | Ueda et al. |
| 8,855,872 | B2 | 10/2014 | Yamazaki |
| 8,881,519 | B2 | 11/2014 | Kamimura |
| 9,085,873 | B2 | 7/2015 | Gabibulayev |
| 9,103,093 | B2 | 8/2015 | Udagawa et al. |
| 9,115,483 | B2 | 8/2015 | Sakuda et al. |
| 9,304,501 | B2 | 4/2016 | Danko |
| 2005/0102866 | A1 | 5/2005 | Sewell et al. |
| 2012/0239199 | A1 | 9/2012 | Danko |
| 2014/0165548 | A1 | 6/2014 | Satake et al. |
| 2014/0166135 | A1 | 6/2014 | Yamashita et al. |
| 2014/0174063 | A1 | 6/2014 | Gabibulayev |
| 2014/0178166 | A1* | 6/2014 | Andruch, III ..... B66C 13/18 414/743 |
| 2014/0178167 | A1 | 6/2014 | Goto et al. |
| 2014/0257647 | A1 | 9/2014 | Wu et al. |
| 2014/0303855 | A1 | 10/2014 | Umeda et al. |
| 2014/0316664 | A1 | 10/2014 | Anders et al. |
| 2014/0326039 | A1 | 11/2014 | Ikegami et al. |
| 2014/0365082 | A1 | 12/2014 | Taylor et al. |
| 2014/0373520 | A1 | 12/2014 | Gehlhoff |
| 2015/0073667 | A1 | 3/2015 | Plagemann et al. |
| 2015/0147147 | A1 | 5/2015 | Uchiyama |
| 2015/0184362 | A1 | 7/2015 | Komiyama |
| 2015/0192241 | A1 | 7/2015 | Shannahan et al. |
| 2015/0299987 | A1 | 10/2015 | Ueda |
| 2016/0032949 | A1 | 2/2016 | Ueda et al. |
| 2016/0053448 | A1 | 2/2016 | Berning et al. |
| 2016/0138240 | A1 | 5/2016 | Ikegami et al. |

FOREIGN PATENT DOCUMENTS

| | | | |
|---|---|---|---|
| JP | S63-217021 | A | 9/1988 |
| JP | H03-221628 | A | 9/1991 |
| JP | 3308450 | B2 | 7/2002 |

* cited by examiner

SYSTEM AND METHOD FOR DEFINING A ZONE OF OPERATION FOR A LIFT ARM

CROSS-REFERENCE TO RELATED APPLICATION

The present application claims the benefit of U.S. Provisional Patent Application Ser. No. 62/416,349, filed Nov. 2, 2016.

BACKGROUND

This disclosure is directed toward power machines. More particularly, this disclosure is directed to power machines with lift arms that can move laterally with respect to at least a portion of the power machine and the control of a lateral position of such a lift arm. One type of power machine that has a lift arm that can move laterally with respect to at least a portion of the power machine is an excavator. Another example of such a power machine is a tractor-loader-backhoe. In some cases, a power machine such as a skid-steer loader can have an implement in the form of a backhoe mounted to the loader that can also move laterally with respect to the loader.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, tractor-loader-backhoes, and trenchers, to name a few examples.

Excavators are a known type of power machine that have an undercarriage and a house that selectively rotates on the undercarriage. The rotational motion of the house is known as a slewing motion. The slewing motion on some excavators allows for infinite rotation of the house in either direction. This can be useful in many applications such as trenching where an operator will dig a trench and then rotate the house to dump spoil. However, in some applications, space may be limited such that full 360-degree rotation of the house may not be possible without running into an obstruction. Further, in some applications, it may be required that digging occur only in a particular work area. With slew, swing (lateral rotational movement of the lift arm relative to the house possible with some excavators) and lift arm motion, control of the location of a lift arm or more particularly, a digging or other work tool attached to a lift arm can be varied through the operation of various actuators including, on some power machines some or all of slew, swing, and lift arm actuators.

The discussion above is merely provided for general background information and is not intended to be used as an aid in determining the scope of the claimed subject matter.

SUMMARY

Disclosed are power machines having a lift arm that is configured to be capable of rotating with respect to some or all of a frame of the power machine. In one embodiment, a power machine in the form of an excavator includes an undercarriage, a house pivotable about a vertical axis with respect to the undercarriage, and a lift arm that is pivotable about a vertical axis with respect to the frame. In one embodiment, the angle of rotation of the house can be selectively controlled to be limited within a predefined angle of actuation and the lift arm can be prevented from pivoting about said vertical axis. In another embodiment, the position of a bucket or implement on the end of the lift arm can be limited to a position within a predefined range of motion.

In another embodiment, a power machine includes a frame and a lift arm mounted to the frame and pivotable with respect to the frame about a vertical or substantially vertical axis. An angle of rotation of the lift arm about the vertical or substantially vertical axis can be selectively controlled to be limited within a predefined angle of actuation and the lift arm can be prevented from pivoting about said vertical axis outside of the predefined angle of actuation.

In another embodiment, a method of controlling a lift arm is disclosed. The method includes predefining a zone of operation of a lift arm and controlling movement about a vertical axis to limit the position of the lift arm within the predefined zone of operation.

This Summary and the Abstract are provided to introduce a selection of concepts in a simplified form that are further described below in the Detailed Description. This Summary is not intended to identify key features or essential features of the claimed subject matter.

BRIEF DESCRIPTION OF THE DRAWINGS

FIG. 7-1 is a flow diagram illustrating one exemplary method of identifying a predetermined range of movement for controlling an excavator.

FIG. 7-2 is a flow diagram illustrating another exemplary method of identifying a predetermined range of movement for controlling an excavator.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments illustrate an excavator and a control system for an excavator that provide for a plurality of modes of operation. The control system includes operator inputs for controlling movement of individual segments of a lift arm, movement of an implement relative to the lift arm, swing of a lift arm relative to a frame about a vertical axis, rotation of a house portion of the frame relative to an undercarriage. A mode select input is provided to select a mode of operation. In a first mode of operation, a controller limits rotation of the house within a predefined angle of rotation. In this mode, the swing function can be disabled. In a second mode of operation, the position of an implement is limited to operate in a predefined zone, and a controller on the excavator can manipulate rotation of the house and swing position to best accommodate that position.

Figure 2:
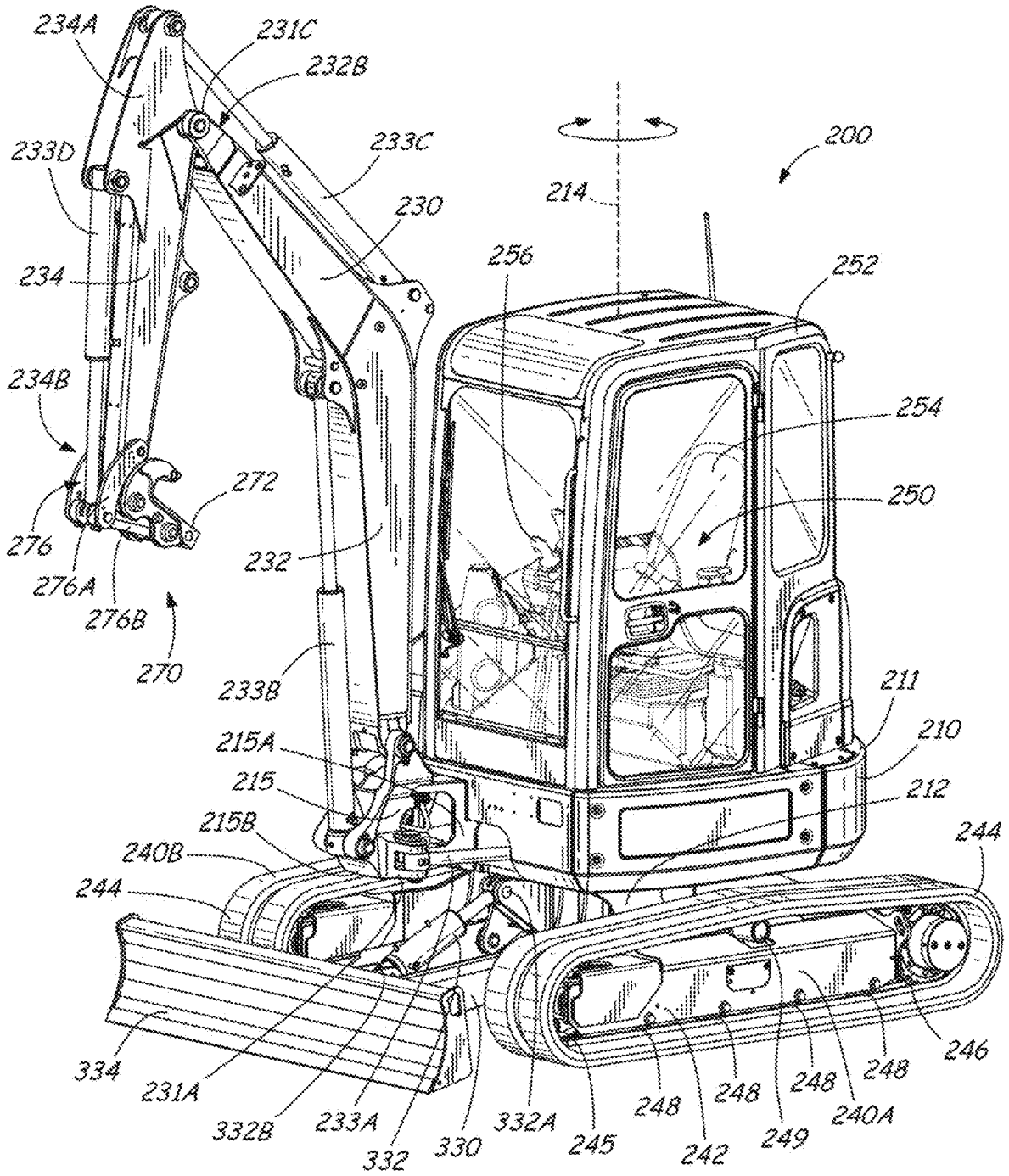
FIG. 2 is a front left perspective view of a representative power machine in the form of an excavator on which the disclosed embodiments can be practiced.
Figure 3:
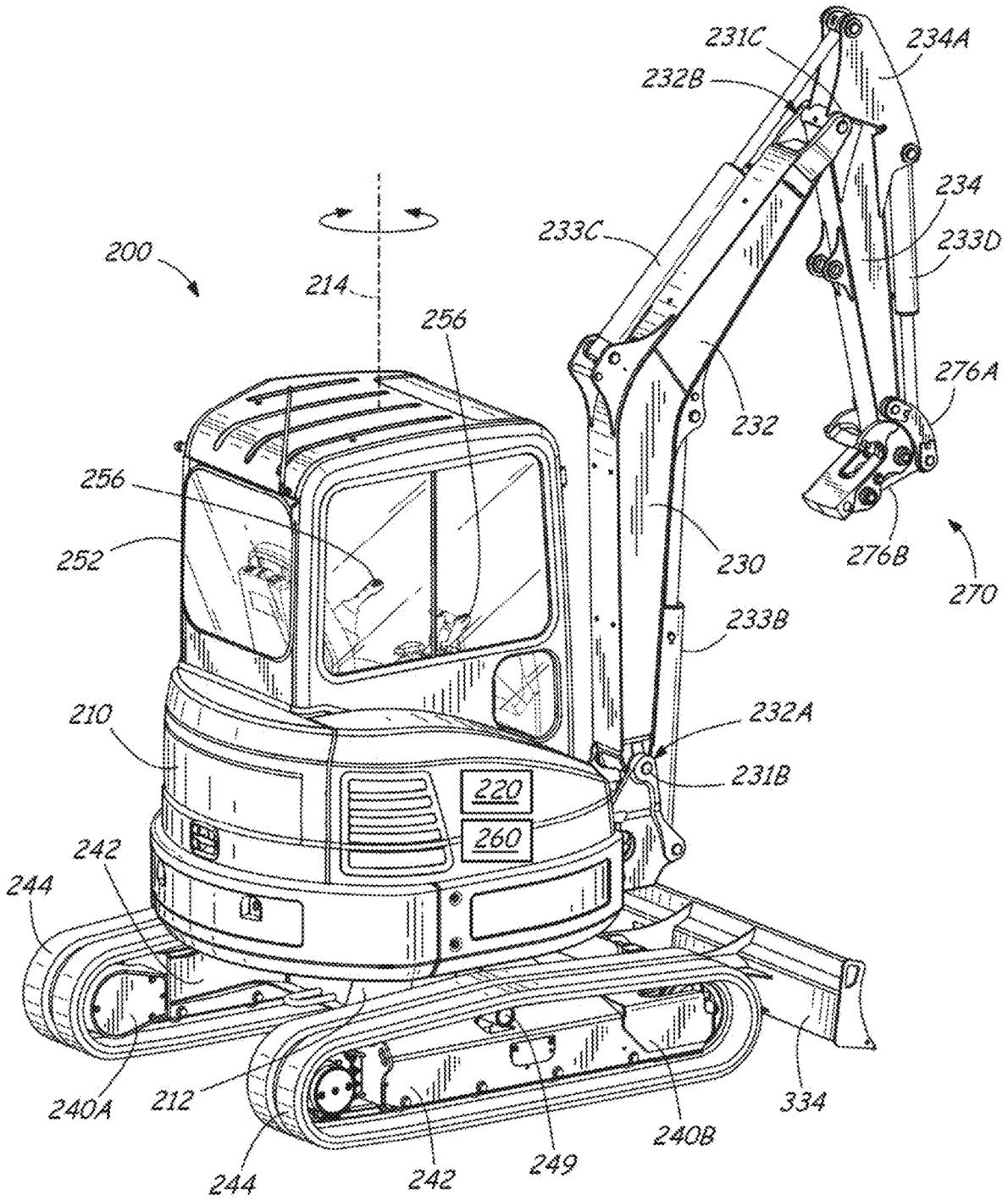
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. For example, some or all of the concepts discussed below and attributed to embodiments showing excavators can also be practiced on power machines such as tractor-loader-backhoes and other loaders. For example a loader with a backhoe implement can be an embodiment that includes some or all of the advantageous features discussed in the illustrated embodiments. Power machines, for the purposes of this discussion, include a frame, at least one work element, and a power source that is configured to provide power to the work element to accomplish a work task. One type of power machine is a self-propelled work vehicle. Self-propelled work vehicles are a class of power machines that include a frame, work element, and a power source that is configured to provide power to the work element. At least one of the work elements is a motive system for moving the power machine under power.

Figure 1:
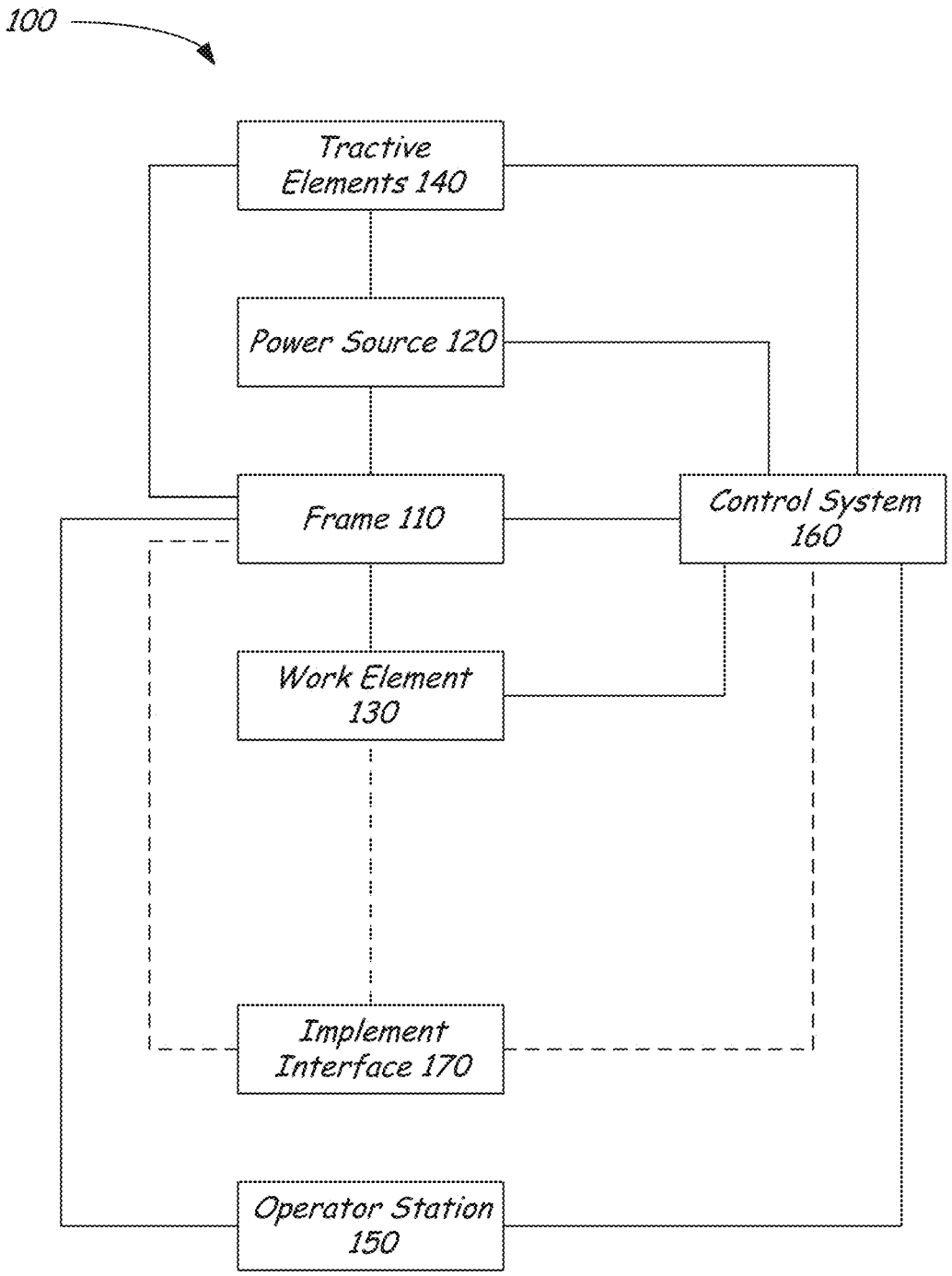
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are configured to perform a dedicated task. For example, some work vehicles have a lift arm to which an implement such as a bucket is attached such as by a pinning arrangement. The work element, i.e., the lift arm can be manipulated to position the implement to perform the task. The implement, in some instances, can be positioned relative to the work element such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates about a swivel with respect to a lower frame portion. Other work vehicles have articulated frames such that one portion of the frame pivots with respect to another portion for accomplishing steering functions. In exemplary embodiments, at least a portion of the power source is located in the upper frame or machine portion that rotates relative to the lower frame portion or undercarriage. The power source provides power to components of the undercarriage portion through the swivel.

Frame 110 supports the power source 120, which is configured to selectively provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that can use it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote-control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1 on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed. A control system, shown as block 260 is provided for controlling the various work elements. Control system 260 includes operator input devices, which interact with the power system 220 to selectively provide power signals to actuators to control work functions on the excavator 200. In some embodiments, the operator input devices include at least two two-axis operator input devices to which operator functions can be mapped.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is configured to be capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about a vertical axis that extends longitudinally through the mounting frame pivot 231A.

The first lift arm structure 230 includes a first portion 232, known generally as a boom, and a second portion 234, known as an arm or a dipper. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is configured to be capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and preventing the track from rubbing on track frame 242.

A second, or lower, lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230, and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4:
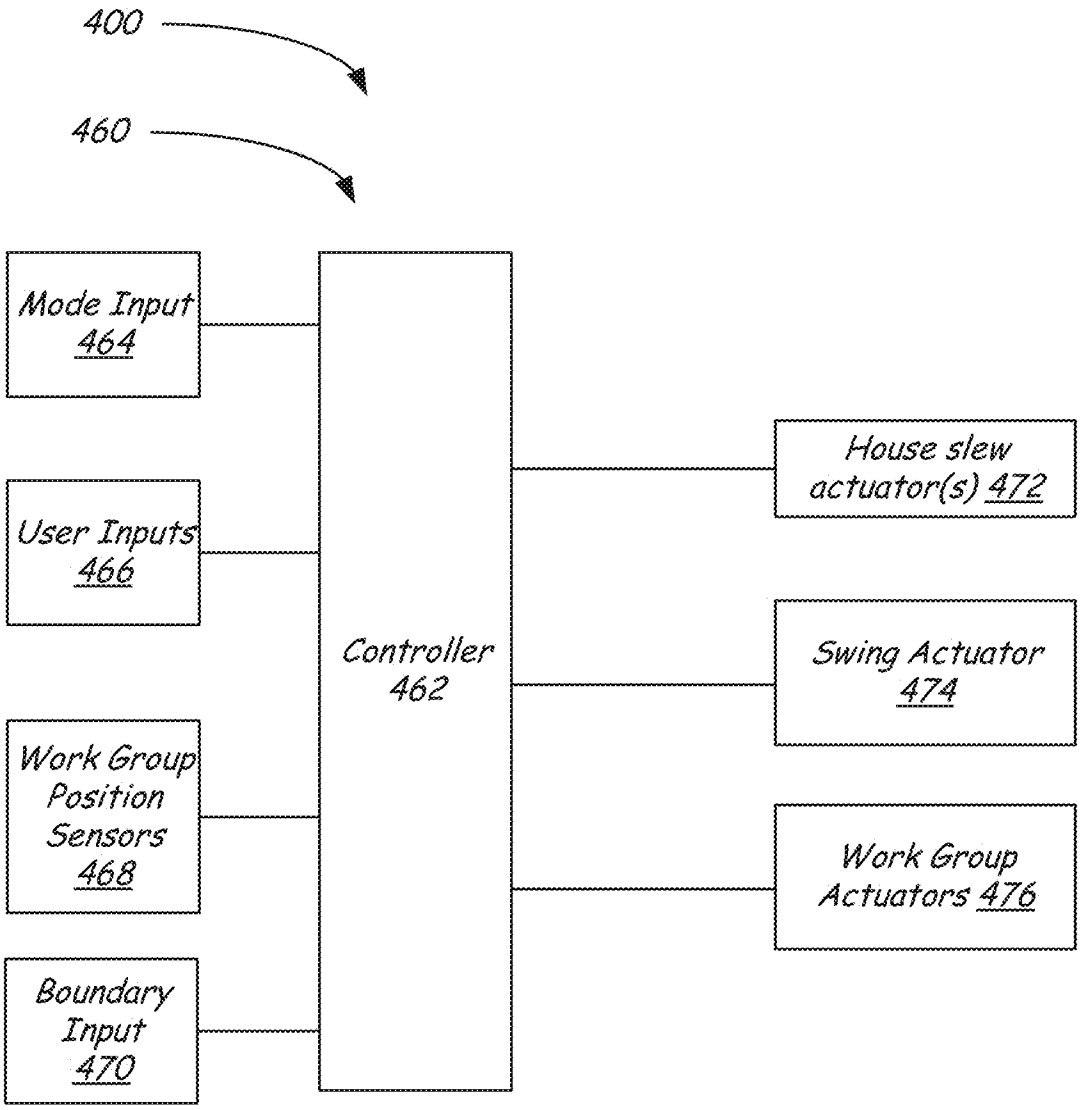
FIG. 4 is block diagram illustrating portions of a control system of a power machine according to one illustrative embodiment.

FIG. 4 is a simplified block diagram that illustrates some functions of a control system 460 for use in a power machine 400, which can be similar to the excavator 200 or other power machines as discussed above. It should be appreciated that a control system for a power machine such as excavator 200 or any other power machine can be more complex than the control system 460 as shown in FIG. 4 and that the simplification of the control system 460 is provided to focus on key features of the control system.

Figure 5:
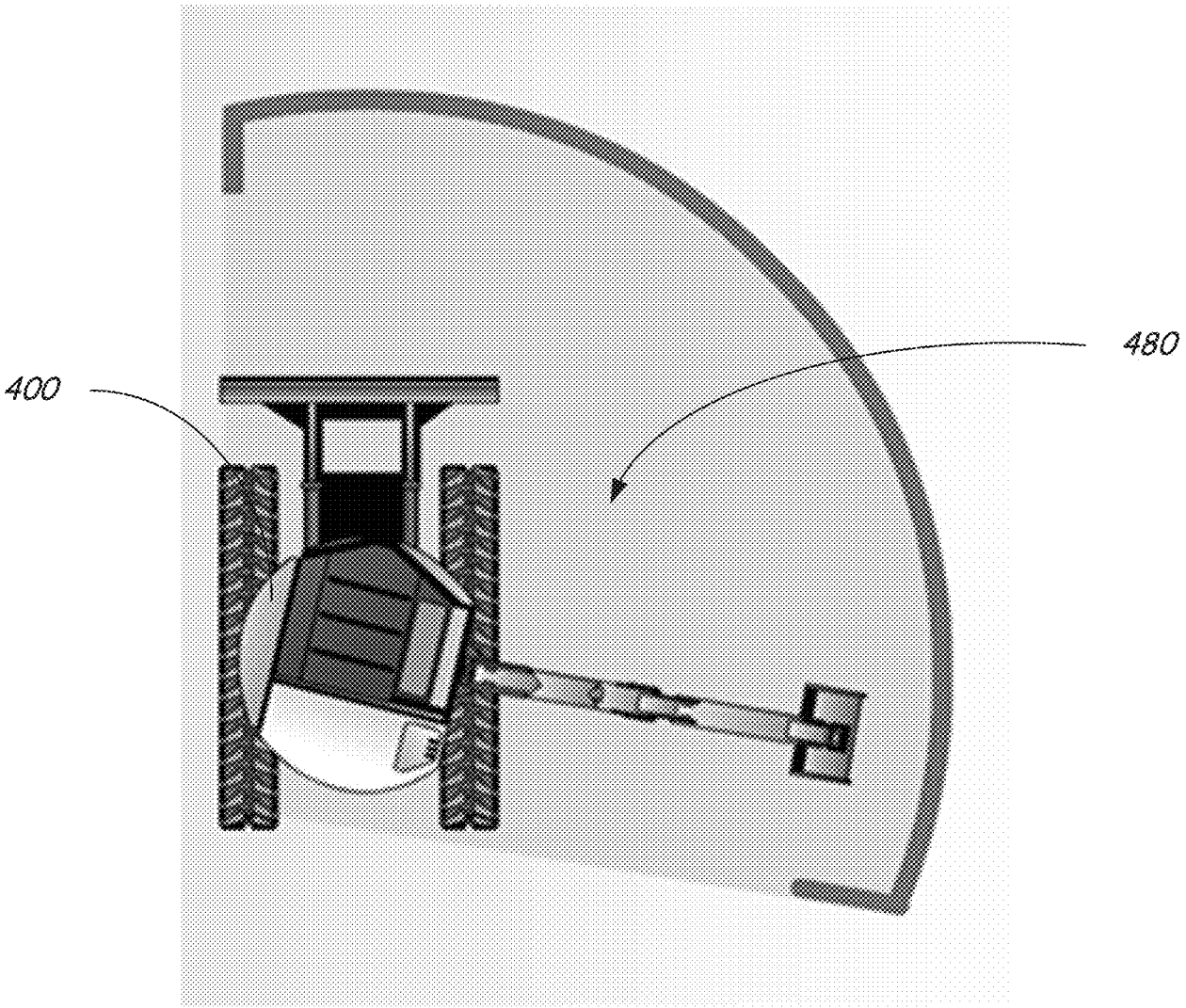
FIG. 5 is a function map diagram illustrating the mapping of control functions to joystick controls in two different modes according to one illustrative embodiment.

Control system 460 includes a controller 462, which can be any suitable electronic controller configured to receive a plurality of input signals from various input devices and providing output signals for controlling actuation devices. The control system 460 also includes a mode input 464, which is manipulable by an operator to select a mode of operation for controlling functions on the machine via actuation devices. In one embodiment, the control system 460 is configured to operate in a first mode and in a second mode to limit movement of the lift arm and/or house as well as in a default mode where movement of the lift arm and house are not limited by the control system 460. FIG. 5 illustrates a zone of operation 480 as a predefined portion of the total available rotation.

Control system 460 also includes user inputs 466 that are manipulable by an operator to provide signals indicative of an intention of an operator to position the house, swing, lift arm, and/or implement. The user inputs can any type of user input that is suitable for use in an excavator to be manipulated by an operator and that can provide an electrical signal, either wired or wireless, to the controller 462. This can include joysticks, levers, buttons, and the like. In some embodiments, the control system 460 includes one or more work group position sensors 468 that are configured to provide position information to the controller 460 relative to the house, swing, and positions of the individual (i.e. the boom and arm) portions of the lift arm as well as an implement position. It should be appreciated that in some embodiments, all these sensors are available to provide signals to the controller 462, while in other embodiments, only some (i.e. swing and house rotation) are available.

The controller 462 is configured to provide output signals to control the position of the house by controlling one or more slew actuators 472, to control swing of the lift arm by controlling the swing actuator 474, and to control the position of the individual portions of the lift arm by controlling work group actuators 476. In addition, the controller 462 is configured to set a pre-defined area of operation for the first and second modes in response to user inputs. In one embodiment, a left-most boundary (from the perspective of an operator positioned at an operator station) is set by moving the house to that position and actuating a user input. Subsequently, a right-most boundary is set by moving the house to that positon and actuating a user input. In some embodiments, power machines can have only a slew actuator and not a swing actuator. For example, some excavators have a lift arm that is rigid. The term rigid in this particular instance refers to the fact that some excavators have lift arms that do not move laterally with respect to the house. Moving the lift arm from side-to-side is accomplished solely by moving the house relative to an undercarriage. In other embodiments, a lift arm may not be capable of moving laterally solely by manipulating a swing actuator. For example, many backhoes mounted on a loader frame or lift arm cannot be moved by rotating one part of a frame with respect to another.

Figure 6:
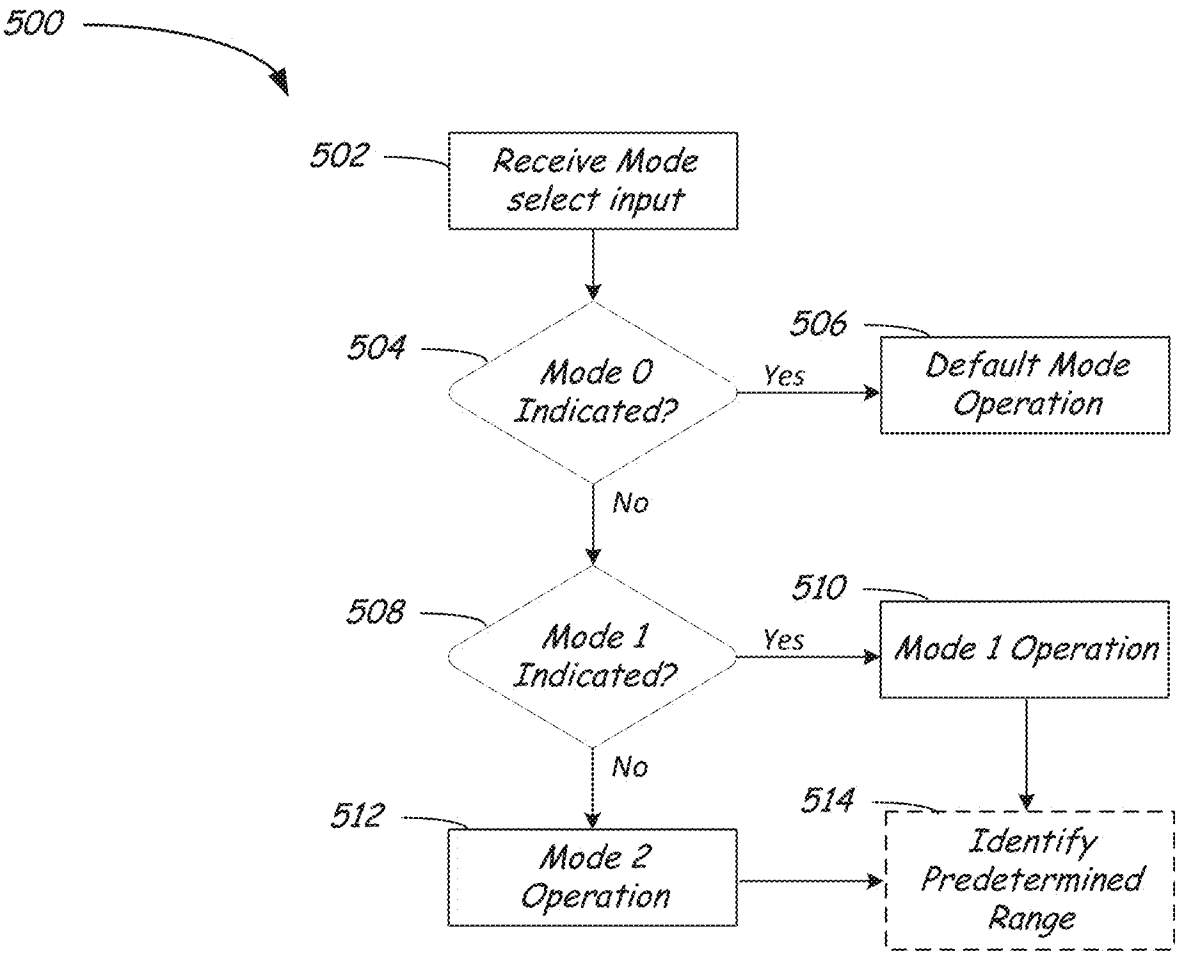
FIG. 6 is a flow diagram illustrating a method of controlling an excavator according to one illustrative embodiment.

FIG. 6 illustrates a method 500 of controlling the position of a lift arm within a predefined range of motion according to one illustrative embodiment. The method below will refer to the control system 460 of FIG. 4 to provide some ease of understanding. The method begins at block 502 of the flowchart, where the controller 462 receives a mode select input. It is assumed for the purposes of this discussion that a range of motion has been pre-defined, but it may also be the case that the range of allowed motion, discussed above, may be set after selecting the mode of operation as shown in optional block 514. Several methods of identifying or establishing the allowed range of motion or predefined work area are described later herein and shown in FIGS. 7-1 and 7-2.

Referring back to FIG. 6, once a mode input select input has been received at block 502, the controller 462 will determine whether the mode input select input has indicated a desire to operate the excavator in a default mode (i.e. mode 0) at block 504. If this is the case, the controller 462 will operate the excavator without any regard for any limitations about the position of the house and/or the swing. This is illustrated at block 506 of the method. If it is determined that the mode select input does not indicate mode 0 or the default mode, the method moves to block 508, where the controller 462 determines whether mode 1 has been selected. If mode 1 has been indicated, the method moves to block 510. At block 510, the controller limits movement of the house within a predefined range. As discussed above, what constitutes a predefined range may be set after entering mode 1. In addition, on those machines with the ability to rotate both a portion of the frame (i.e., the house) and the lift arm relative to the frame (i.e., the swing) the swing position can be locked so that the lift arm cannot swing. The position of the house and swing are indicated to the controller 462 by work group sensors 468. These sensors can be of any suitable type. In one embodiment, movement of the lift arm may be limited or prohibited until the operator has adjusted the swing so that the lift arm is positioned directly forward as is shown in FIG. 2. During operation, movement of the lift arm (other than swing) is uninhibited. Rotation of the house is allowed within the predefined range of operation. It should be appreciated that in some embodiments, only the default mode and mode 1 are available.

Returning to block 508, if the controller determines that mode 2 has been indicated, the method moves to block 512 and the control system 460 operates under mode 2. In mode 2, the controller limits the position of an implement to a predefined range of operation. To define the range the implement is positioned by the operator to the leftward most position and a leftward limit is indicated. Subsequently, the implement is positioned at a rightward most position and the rightward position is indicated. The position of the implement would thus be limited to operate within this space from left to right. In this mode, the reach of the lift arm is not limited. Movement of the house and swing are not specifically limited except that they can move only to accommodate a position within the predefined zone of operation. For example, a leftward most position of the implement may be accomplished by rotating the house leftward and swing the lift arm rightward. To reach that position in operation, the controller would have to rotate the house and swing to achieve that position. While the above example illustrates only two positions to define a space in which an implement can be located while functioning in mode 2, in some embodiments, it may be the case that more than two positions can be set to define a space of operation. Movement of the excavator via the traction system may also require a redefinition of the space of operation and/or re-selection of a mode. Alternatively, if the controller does not sense movement of the traction system, such movement will function to shift the space operation, because if the machine has moved and the space of operation has been defined, the entire space of operation will be shifted by the machine's movement (via the traction system). In other words, the system in such embodiments operates to define zone of operation as a function of the relative position of the house to the undercarriage.

Figures 1, 7:
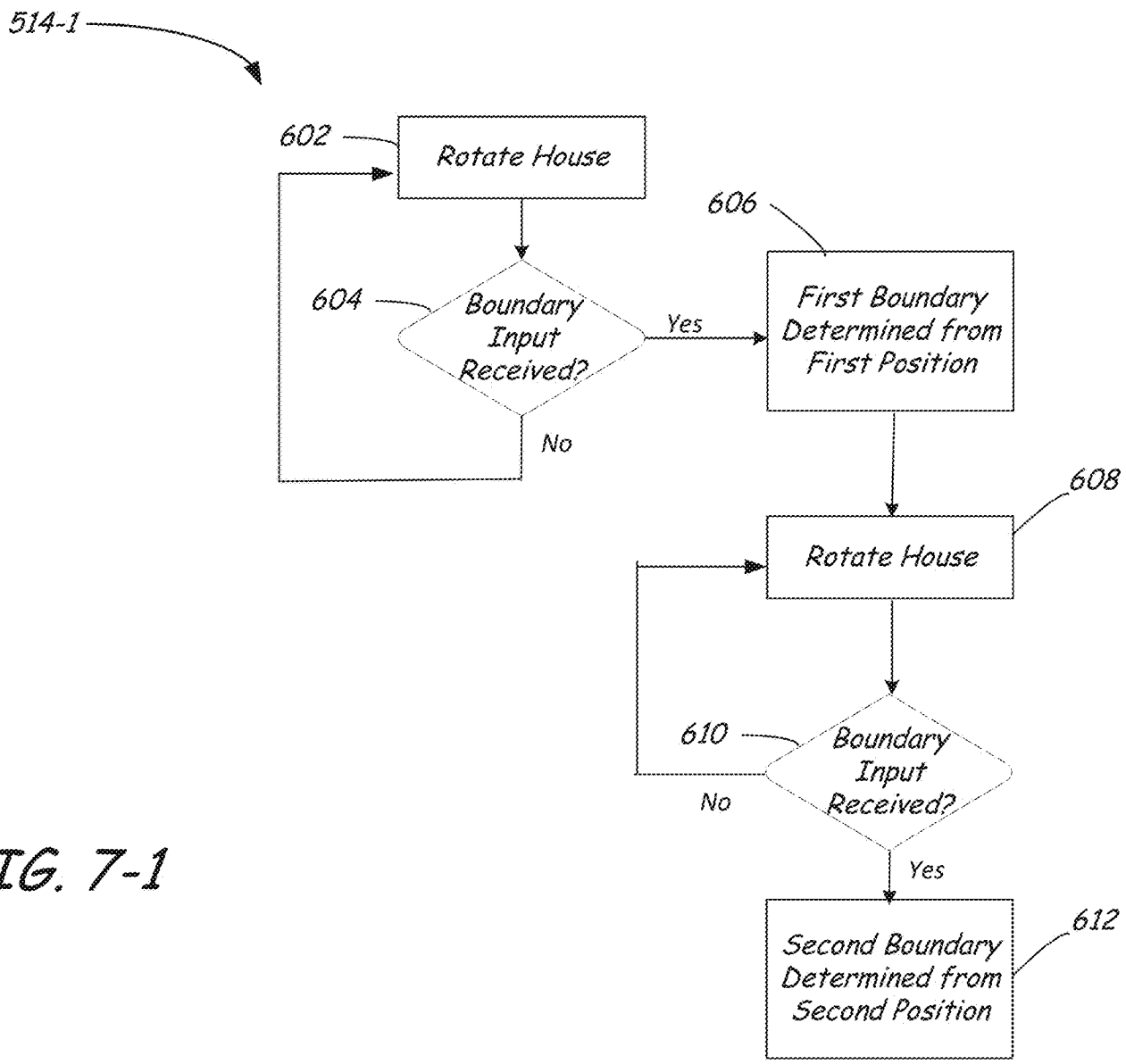
Figures 2, 7:
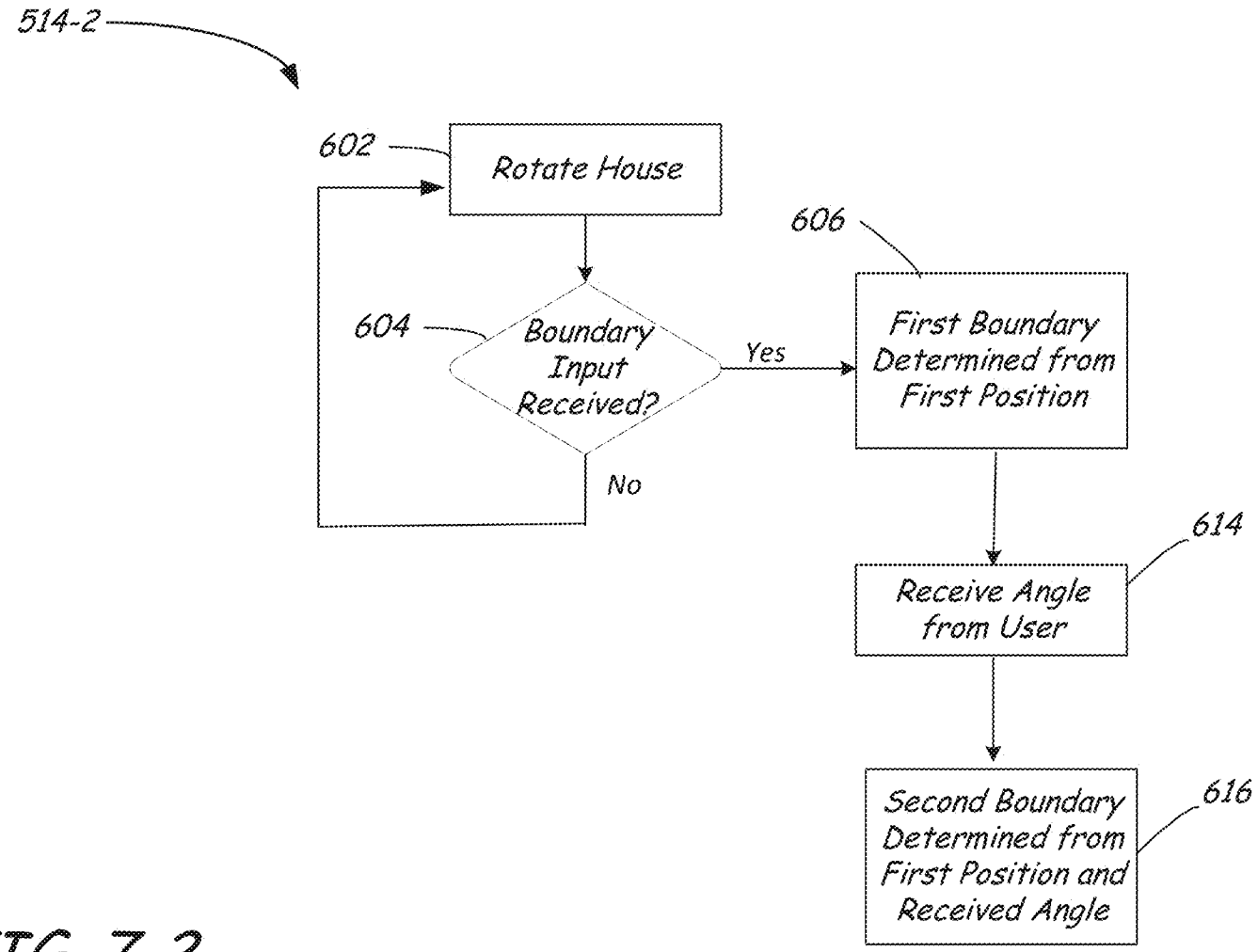
Figure 8:
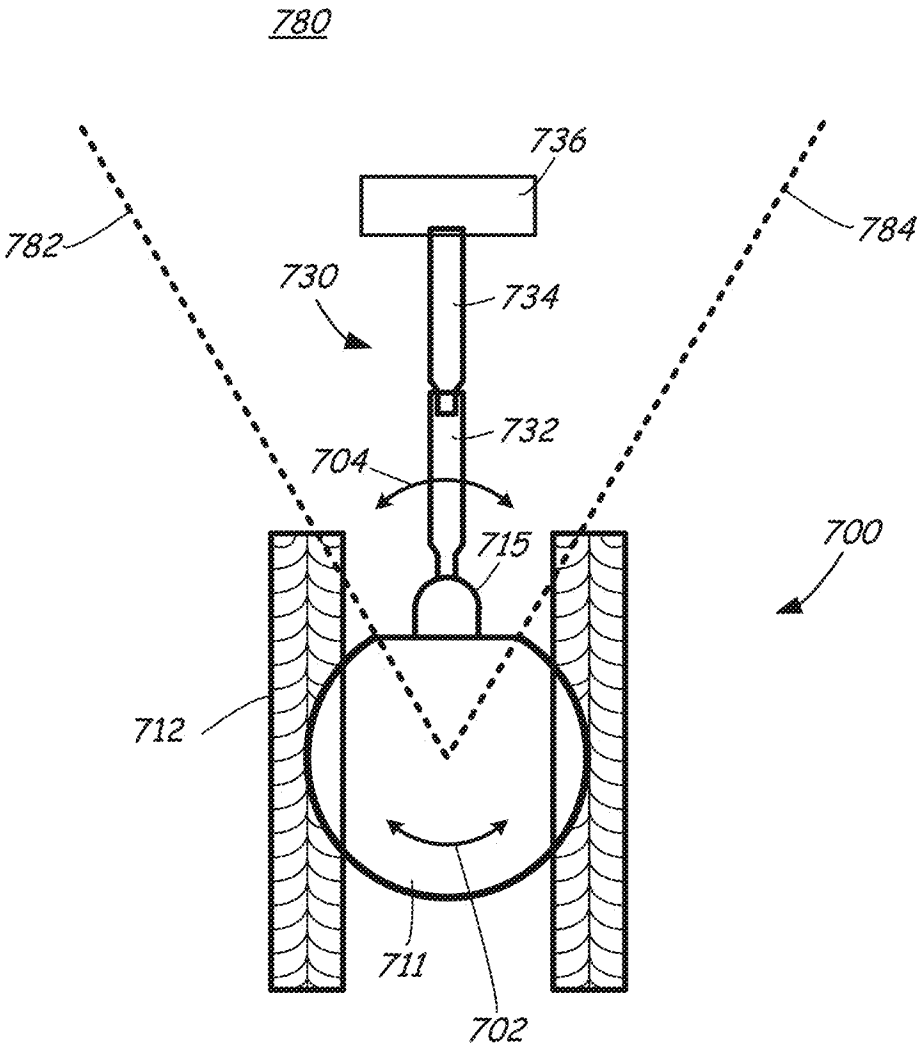
FIG. 8 is a diagrammatic top view illustration of an excavator having slew, swing and lift arm functions operating in a predefined range of operation.

FIG. 7-1 illustrates one example method 514-1 of identifying the predetermined range of operation as illustrated in block 514 of FIG. 6. The method is illustrated using an exemplary excavator 700 shown in FIGS. 8, 9A and 9B. Similar to the above-discussed excavators, excavator 700 includes a house 711 rotatably mounted to an undercarriage 712 and configured to be fully rotated (e.g., 360-degrees) in directions represented by arrow 702 by a slew actuator (e.g., actuator 472). The lift arm structure can be pivotally raised and lowered relative to the house by lift arm actuators (e.g., work group actuators 476 such as actuators 233B and 233C). A swing mount 715 also allows the lift arm structure 730 to be rotated laterally relative to the house in directions represented by arrow 704 by a swing actuator (e.g., swing actuator 233A and 474). In exemplary embodiments, the lift arm structure 730 includes a boom 732 and a dipper 734 as discussed above with reference to FIGS. 2 and 3. An implement carrier (not shown) at an end of dipper 734 is configured to mount an implement 736 to the lift arm structure for performing work tasks such as digging. As discussed with reference to FIG. 7-1 and illustrated in FIGS. 9A and 9B, first and second boundaries 782 and 784 define a work area 780 in which any work performed by implement 736 is to be contained.

Figure 9B:
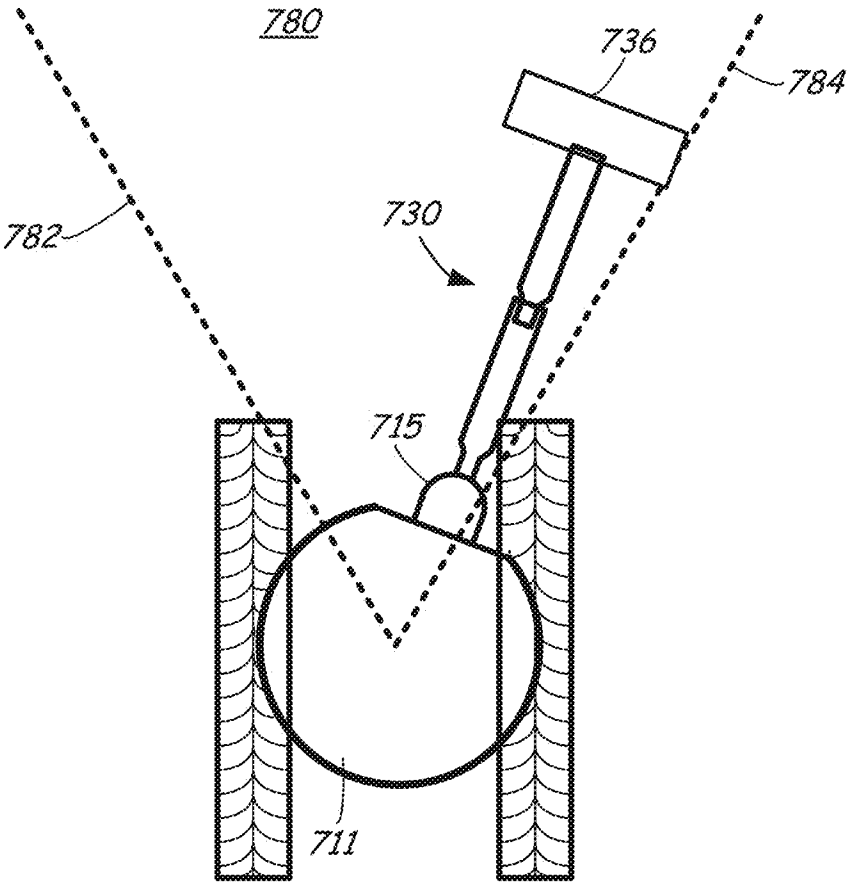
FIGS. 9A and 9B are diagrammatic top view illustrations of the excavator of FIG. 8 showing a first method of identifying the predetermined range of operation.
Figure 9A:
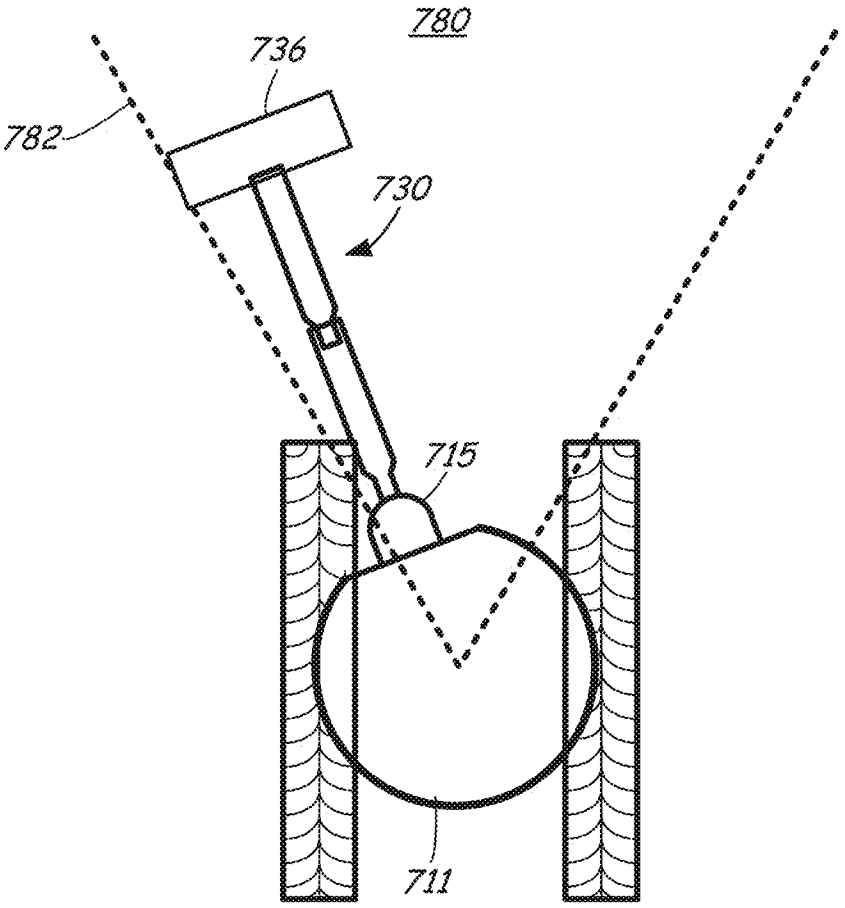

Referring to method 514-1 illustrated in flowchart form in FIG. 7, at block 602 house 711 is rotated in a first direction to a first position and a decision is made at block 604 as to whether a boundary input has been received from a boundary input device 470 (shown in FIG. 4). If a boundary input has been received, then at block 606 a controller 462 determines first boundary 782 from the position of the house 711 or from the position of the implement 736 when the boundary input was received. For example, FIG. 9A illustrates house 711 rotated to the left and lift arm structure 730 extended to position implement 736. The position of implement 736 when the boundary input is received can be used to determine first boundary 782, and the first boundary can be stored by controller 462. As discussed above and as should be considered during the discussion of these examples, various embodiments of power machines can position the implement using one or both of a slew actuator and a swing actuator. To reduce confusion, only embodiments that allow for positioning of the actuator by using a swing actuator and a slew actuator will be discussed going forward, but that should not be any indication that alternative embodiments can be employed with only one of these actuators.

After the first boundary 782 has been determined, house 711 is again rotated, for example in a second direction opposite the first direction, to a second position, as shown in block 608. If, at block 610, a second a boundary input has been received from a boundary input device 470, then at block 612 controller 462 determines second boundary 784 from the position of the house 711 or from the position of the implement 736 when the second boundary input was received. This position is illustrated in FIG. 9B. Controller 462 stores the second boundary 784, and boundaries 782 and 784 together define the predefined range and the corresponding work area.

Figure 10:
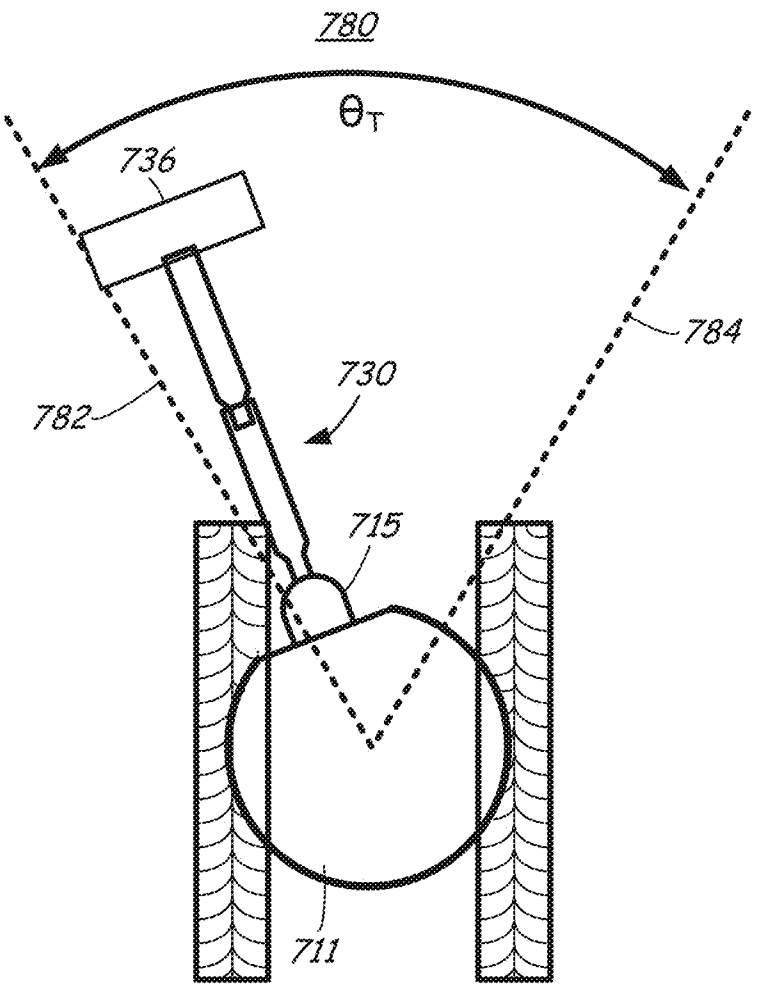
FIG. 10 is a diagrammatic top view illustration of the excavator of FIG. 8 showing a second method of identifying the predetermined range of operation.

FIG. 7-2 illustrates an alternate example method 514-2 of performing the optional step 514 of identifying the predetermined range of operation. The method is further illustrated using excavator 700 in FIG. 10. Method 514-2 determines the first boundary 782 in the same manner as discussed with reference to method 514-1 in blocks 602, 604 and 606. However, in method 514-2, instead of moving the house 711 to a second position to determine the second boundary 784, at a step 614 a total angle $\Theta_T$ for the predefined range is received from the user using a user input device. Controller 462 then determines at block 616 the second boundary from the first position or boundary 782 and the total angle $\Theta_T$ received from the user. This is illustrated for example in FIG. 10. The first position can either of a leftmost position or a rightmost position, with the second position being the other of the leftmost position and the rightmost position.

Figure 11:
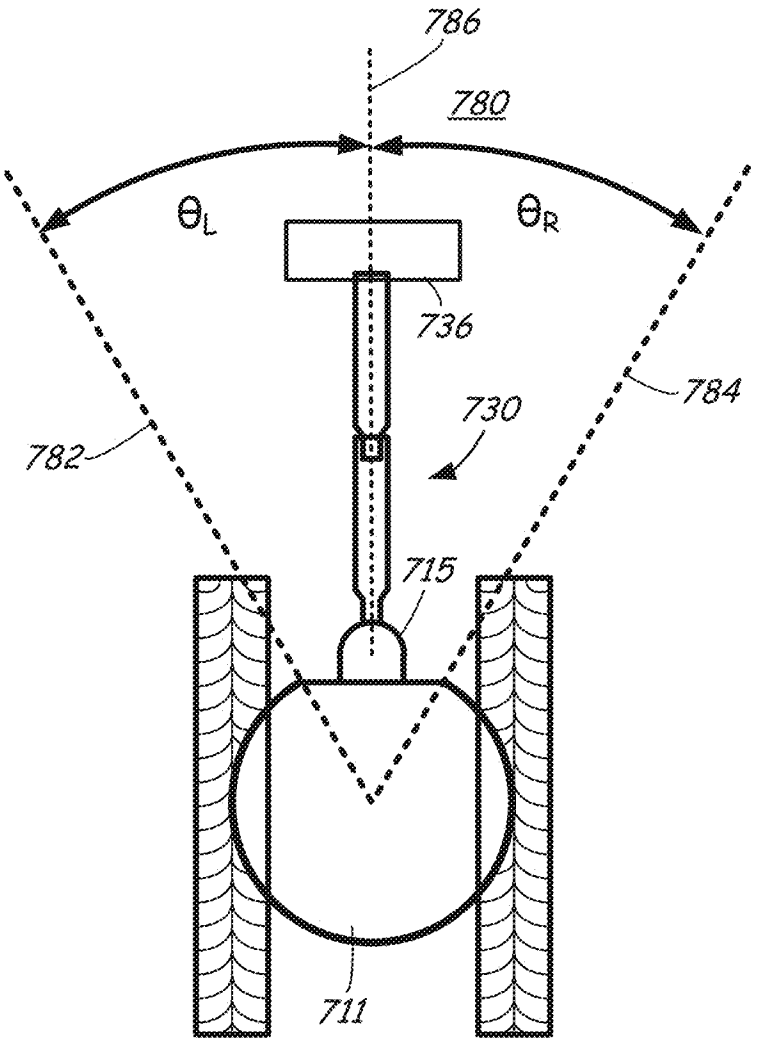
FIG. 11 is a diagrammatic top view illustration of the excavator of FIG. 8 showing a third method of identifying the predetermined range of operation.

While two exemplary methods of determining or identifying the predefined range and corresponding work area 780 have been discussed with reference to FIGS. 7-1 and 7-2, other methods and techniques can also be employed. For example, another technique for identifying the predefined range is illustrated in FIG. 11. With house 711 and lift arm structure 730 oriented straight forward defining a straight forward direction 786, first and second angles (e.g., left angle $\Theta_L$ and right angle $\Theta_R$) can be entered by the user using a user input device. The first and second boundaries 782 and 784 can then be determined from the straight forward position or direction 786 and the first and second angles. In some embodiments in which the first and second angles are equal and the predefined range is to be centered around the straight forward position or direction 786, only one angle need to input by the user. In other embodiments, a position can be selected as a reference location that is not in the straight forward position, with left and right angles defined from the selected reference location that are the same or different from each other. The discussions below reflect an embodiment with a straight forward position selected as a reference location for expediency's sake, but other positions can be used as a reference location.

Figure 13:
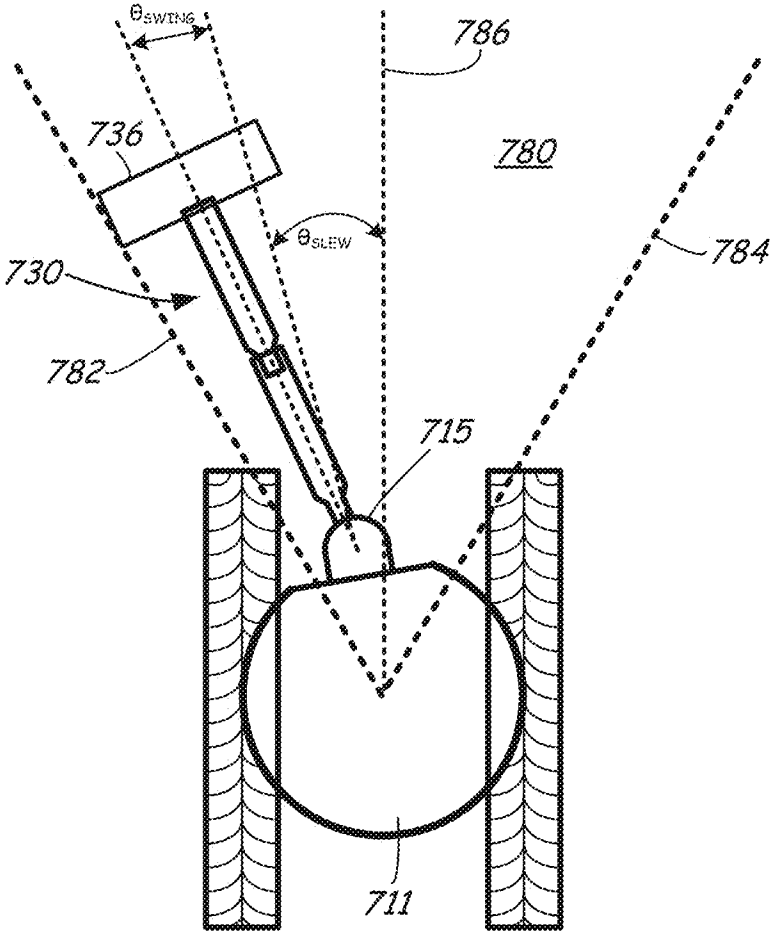
FIG. 13 is a diagrammatic top view illustration of the excavator of FIG. 8 showing both slew movement of the house and swing movement of the lift arm structure to position the implement within the work area defined by the predetermined range of operation.
Figure 12:
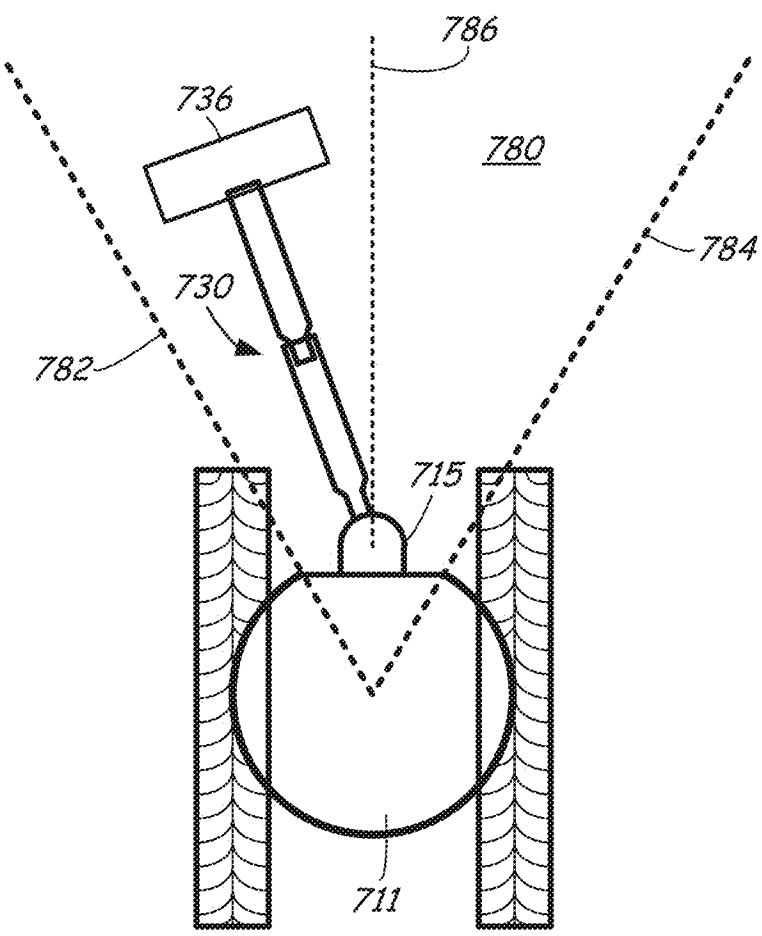
FIG. 12 is a diagrammatic top view illustration of the excavator of FIG. 8 showing swing movement of the lift arm structure to position an implement within a work area defined by the predetermined range of operation.
Figure 14:
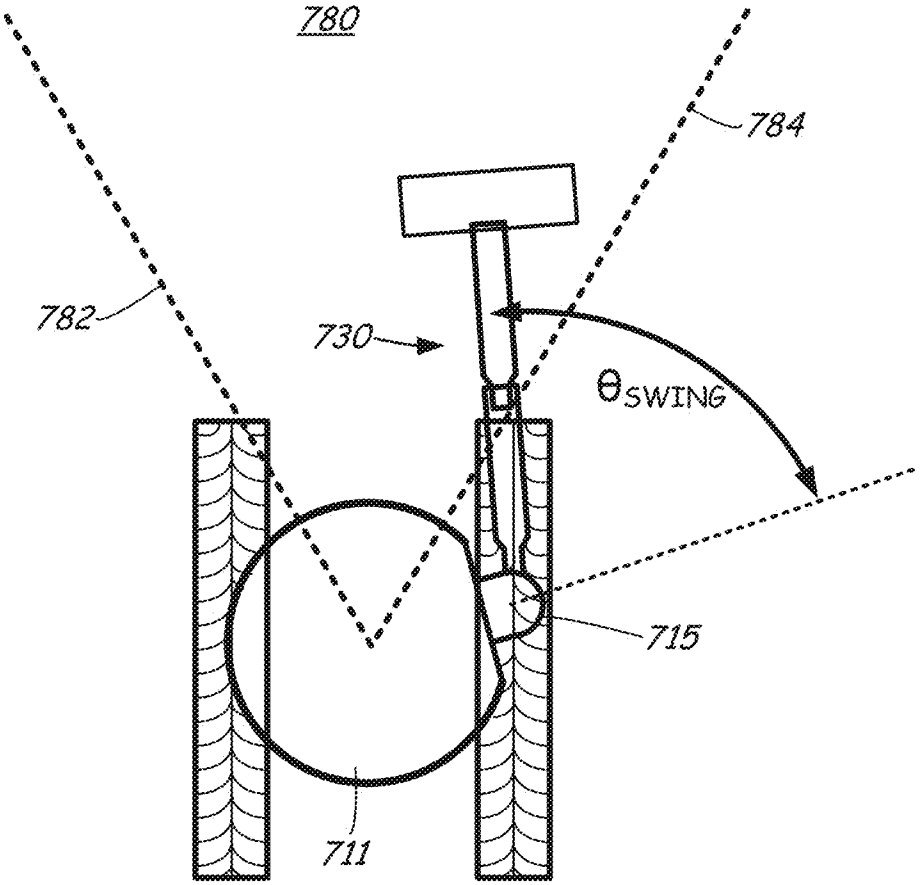
FIG. 14 is a diagrammatic top view illustration of the excavator of FIG. 8 showing slew movement of the house outside of the predetermined range of operation combined with swing movement of the lift arm structure to position the implement within the work area defined by the predetermined range of operation.

Once the predefined range has been identified or determined, controller 462 can control the house slew actuator(s), the swing actuator(s) and/or the work group actuators (e.g., the lift arm actuators) to contain work performed by implement 736 to within the work area defined by the predefined range. For example, FIG. 12 illustrates excavator 700 with house 711 oriented straight forward (or at the reference location), while lift arm structure 730 is rotated laterally relative to the straight forward direction 786. Any swing control signals received by the controller from a swing user input would result in the controller controlling the swing actuator to rotate the lift arm structure accordingly, so long as implement 736 would not be positioned outside of work area 780. If further swing rotation of the lift arm structure 730 would place implement 736 outside of work area 780, then in the Mode 1 and Mode 2 operations, controller 462 would stop further swing movement regardless of commanded movement from the swing user input. If house 711 has been rotated from the straight forward orientation by the slew actuators (e.g., by an angle $\Theta_{SLEW}$) as shown in FIG. 13, then swing rotation of lift arm structure 730 by swing actuator(s) (e.g., by an angle $\Theta_{SWING}$) in the same direction would be more limited by the controller to maintain implement 736 within the work area 780. However, rotation of house 711 in the opposite direction could increase the amount of swing rotation allowed by the controller. For example, in FIG. 14, house 711 is shown to have been rotated to the right such that swing mount 715 is positioned outside of the predefined range and work area 780, allowing for a large swing angle $\Theta_{SWING}$ to position the implement inside of the work area.

In various embodiments, controller 462 is configured to restrain any or all of house rotation relative to the undercarriage, lift arm structure swing rotation relative to the house, and work group (e.g., lift arm) raising and lowing movements between the boom and the house or between the dipper and the boom, in order to contain work performed by the implement to the predefined range and corresponding work area. Such restraining of movements is irrespective of user input commands to move beyond necessary constraints to achieve this goal. However, while limiting movements to contain work performed to the defined work area, utilizing the control of all of the house rotation, the lift arm structure swing rotation and the work group movements allows the implementation of digging using complex geometry work areas in some embodiments.

Also, in various embodiments, position feedback may be necessary to allow the controller to identify precise rotational orientations of the house, lift arm swing orientations, and lift arm work group orientations. Without position sensors or other forms of position feedback, in some embodiments controller 462 is configured to lock out or prohibit certain of these movements by controlling the corresponding actuator(s). For example, without swing position feedback, controller 462 may prohibit all swing movement of the lift arm structure when operating in a mode other than the default mode. In some embodiments, an override input can be provided that will allow an operator to move the lift arm out of the predefined zone of operation. In some embodiments, controller 462 would sense when the lift arm has returned to the predefined zone of operation and then re-engage the zone of operation to prevent movement out of the zone of operation. In other embodiments, an operator would have to manipulate an input to stop the override and re-engage the pre-defined zone of operation.

Further, while boundary inputs provided by a boundary input device 470 are described, determination of the predefined range and work area can be aided using a variety of different information provided by a variety of different user inputs. For example, the user inputs can be actuated switches or buttons in the operator compartment, softkeys on a touchscreen display device, a rotational switch, etc.

The embodiments discussed above provide important advantages. By limiting the space in which a lift arm can move on an excavator or other power machine, an operator can operate in tight spaces and avoid objects such as buildings to prevent damage to such objects and/or the excavator.

Although the present invention has been described with reference to preferred embodiments, workers skilled in the art will recognize that changes may be made in form and detail without departing from the scope of the discussion.

What is claimed is:

1. A method of controlling operation of an excavator having a lift arm structure pivotally mounted to a house by a swing mount to allow the lift arm structure to be rotated laterally relative to the house by a swing actuator, an implement mounted to the lift arm structure, and an undercarriage to which the house is rotatably mounted to allow 360-degree rotation of the house relative to the undercarriage by a slew actuator, the method comprising:

receiving, at a controller, a mode selection input from a mode input device manipulated by an operator to select a mode of operation of the excavator;

determining, using the controller, from the mode selection input whether the selected mode is a first mode of operation in which full 360-degree rotational movement of the house by the slew actuator responsive to a slew user input is allowed, or whether the selected mode is a second mode of operation in which rotational movement of the house by the slew actuator is limited to a predefined range to limit positioning of the implement to a work area defined by a predefined range;

identifying, using the controller, the predefined range if it was determined that the selected mode is the second mode of operation;

receiving, at the controller, from the slew user input a slew control signal commanding rotational movement of the house relative to the undercarriage;

receiving, at the controller, from a swing user input a swing control signal commanding lateral rotational movement of the lift arm structure relative to the house;

controlling, using the controller, the slew actuator to rotate the house relative to the undercarriage responsive to the slew control signal, wherein when the selected mode is the first mode the slew actuator is controlled responsive to the slew control signal to allow full 360-degree rotation of the house relative to the undercarriage, and wherein when the selected mode is the second mode the slew actuator is controlled responsive to the slew control signal to limit rotation of the house relative to the undercarriage to the predefined range or to move the implement into, or maintain the implement within, the work area defined by the predefined range; and controlling, using the controller, the swing actuator to laterally rotate the lift arm structure relative to the house responsive to the swing control signal, wherein when the selected mode is the second mode the controller controls the swing actuator to allow commanded lateral rotational movement of the lift arm structure relative to the house only if such lateral rotational movement moves the implement into, or maintains the implement within, the work area defined by the predefined range.

2. The method of claim 1, wherein identifying, using the controller, the predefined range further comprises:

controlling, using the controller, the slew actuator to rotate the house to a first house position;

receiving, at the controller, a first boundary input from a boundary input device in response to actuation of the boundary input device while the house is at the first house position; and determining a first boundary of the predefined range based upon the first house position.

3. The method of claim 2, wherein identifying, using the controller, the predefined range further comprises:

controlling, using the controller, the slew actuator to rotate the house to a second house position;

receiving, at the controller, a second boundary input from the boundary input device in response to actuation of the boundary input device while the house is at the second house position; and determining, using the controller, a second boundary of the predefined range based upon the second house position.

4. The method of claim 2, wherein identifying, using the controller, the predefined range further comprises:

receiving, at the controller, a signal from a user input device indicative of an angle;

determining, using the controller, a second boundary of the predefined range based upon the first boundary and the received angle.

5. The method of claim 1, wherein identifying, using the controller, the predefined range further comprises:

receiving, at the controller, a first angle from the user input device; and determining, using the controller, a first boundary of the predefined range based upon the first angle and a reference location position of the house.

6. The method of claim 5, wherein identifying, using the controller, the predefined range further comprises determining a second boundary of the predefined range based upon the first angle and a straight forward position of the house.

7. The method of claim 5, wherein identifying, using the controller, the predefined range further comprises:

receiving, at the controller, a second angle from the user input device; and determining, using the controller, a second boundary of the predefined range based upon the second angle and the reference location position of the house.

8. The method of claim 1, wherein controlling, using the controller, the slew actuator to rotate the house relative to the undercarriage responsive to the slew control signal when the selected mode is the second mode further comprises allowing the slew actuator to rotate the house outside of the predefined range if the swing control signal commands lateral rotational movement of the lift arm structure relative to the house which moves the implement into, or maintains the implement within, the work area defined by the predefined range.

9. The method of claim 1, and further comprising:

receiving, at the controller, lift arm control signals from one or more lift arm user inputs commanding movement of the lift arm structure to position the implement;

controlling, using the controller, the one or more lift arm actuators to position the implement, wherein when the selected mode is the second mode the controller controls the one or more lift arm actuators to allow commanded implement positioning only if such implement positioning by the lift arm structure moves the implement into, or maintains the implement within, the work area defined by the predefined range.

10. A power machine comprising:

a frame having an undercarriage and a house rotatably mounted to the undercarriage to allow 36-degree rotation of the house relative to the undercarriage;

a slew actuator configured to rotate the house relative to the undercarriage;

a lift arm structure operably coupled to the house by a swing mount to allow the lift arm structure to be laterally pivoted with respect to the house, the lift arm structure configured to have an implement mounted thereto and further configured to be pivotally raised and lowered relative to the house;

at least one lift arm actuator configured to raise and lower the lift arm relative to the house to position an implement mounted on the lift arm structure;

a swing actuator configured to laterally rotate the lift arm structure relative to the house;

a mode input device configured to be manipulated by an operator to generate a mode selection input to select a mode of operation of the power machine;

a controller configured to determine from the mode selection input whether the selected mode is a first mode of operation in which full 360-degree rotation of the house relative to the undercarriage by the slew actuator is allowed for positioning the lift arm structure responsive to a slew user input and in which full lateral movement of the lift arm structure relative to the house by the swing actuator is allowed responsive to a swing user input, or whether the selected mode is a second mode of operation in which the slew actuator is controlled to limit rotation of the house relative to the undercarriage and in which the swing actuator is controlled to limit lateral rotation of the lift arm relative to the house to limit to limit positioning of the implement to a work area defined by a predefined range, the controller further configured to identify the predefined range if it is determined that the selected mode is the second mode of operation and to control the slew actuator responsive to a slew control signal from the slew user input and the swing actuator responsive to a swing control signal from the swing user input to limit rotation of the house relative to the undercarriage and to limit lateral rotation of the lift arm structure relative to the house to limit positioning of the implement to the work area defined by the predefined range.

11. The excavator of claim 10, and further comprising a boundary input device configured to be manipulated by the operator to generate boundary inputs, wherein the controller is configured to identify the predefined range by controlling the swing actuator to laterally rotate the lift arm structure to a first lift arm position, receive a first boundary input from the boundary input device while the lift arm structure is at the first lift arm position, and determine a first boundary of the predefined range based upon the first lift arm position.

12. The excavator of claim 11, wherein the controller is further configured to identify the predefined range by controlling the swing actuator to laterally rotate the lift arm structure to a second lift arm position, receive a second boundary input from the boundary input device while the lift arm structure is at the second lift arm position, and determine a second boundary of the predefined range based upon the second lift arm position.

13. The excavator of claim 11, wherein the controller is further configured to identify the predefined range by receiving a signal indicative of an angle from a user input device, and to determine a second boundary of the predefined range based upon the first boundary and the received angle.

14. The excavator of claim 10, wherein the controller is configured to identify the predefined range by receiving a first angle from a user input device, and determine a first boundary of the predefined range based upon the first angle and a reference location position of the lift arm structure.

15. The excavator of claim 14, wherein the controller is further configured to identify the predefined range by determining the second boundary of the predefined range based upon the first angle and the reference location position of the lift arm structure such that the reference location position of the lift arm structure is centered between the first and second boundaries of the predefined range.

16. The excavator of claim 14, wherein the controller is further configured to identify the predefined range by receiving a second angle from the user input device, and determining a second boundary of the predefined range based upon the second angle and the reference location position of the lift arm structure.

17. The excavator of claim 10, and further comprising a boundary input device configured to be manipulated by the operator to generate boundary inputs, wherein the controller is configured to identify the predefined range by controlling the slew actuator to rotate the house to a first house position, receive a first boundary input from the boundary input device while the house is at the first house position, and determine a first boundary of the predefined range based upon the first house position.

18. The excavator of claim 17, wherein the controller is further configured to identify the predefined range by controlling the slew actuator to rotate the house to a second house position, receive a second boundary input from the boundary input device while the house is at the second house position, and determine a second boundary of the predefined range based upon the second house position.

19. The excavator of claim 17, wherein the controller is further configured to identify the predefined range by receiving a signal indicative of an angle from a user input device, and to determine a second boundary of the predefined range based upon the first boundary and the received angle.

* * * * *